US012692640B2

(12) United States Patent
Leisl, III et al.

(10) Patent No.: US 12,692,640 B2
(45) Date of Patent: Jul. 28, 2026

(54) LOCATING FEATURES FOR A CONTROL PANEL OF A DOMESTIC APPLIANCE

(71) Applicant: Haier US Appliance Solutions, Inc., Wilmington, DE (US)

(72) Inventors: Donald James Leisl, III, Louisville, KY (US); John Andrew Schmelz, Charlestown, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 91 days.

(21) Appl. No.: 18/777,050

(22) Filed: Jul. 18, 2024

(65) Prior Publication Data

US 2026/0022505 A1 Jan. 22, 2026

(51) Int. Cl.
*D06F 34/34* (2020.01)

(52) U.S. Cl.
CPC ..... *D06F 34/34* (2020.02)

(58) Field of Classification Search
CPC ..... D06F 34/34
USPC ..... 68/3 R
See application file for complete search history.

(56) References Cited

U.S. PATENT DOCUMENTS

| | | | | |
|---|---|---|---|---|
| 3,814,491 | A * | 6/1974 | Kackley | F16B 2/241 403/353 |
| 9,359,707 | B2 | 6/2016 | Bas | |
| 2008/0256984 | A1* | 10/2008 | Lim | D06F 34/34 68/12.23 |
| 2024/0053956 | A1* | 2/2024 | Leisl, III | D06F 34/08 |

FOREIGN PATENT DOCUMENTS

| | | | |
|---|---|---|---|
| CN | 105525491 | A | 4/2016 |
| CN | 107475998 | B | 9/2022 |
| KR | 100854999 | B1 | 8/2008 |
| KR | 101233193 | B1 | 2/2013 |

* cited by examiner

*Primary Examiner* — Tinsae B Ayalew
(74) *Attorney, Agent, or Firm* — Dority & Manning, P.A.

(57) ABSTRACT

A washing machine appliance may include a cabinet. The cabinet may include a front panel at a top thereof. The washing machine may include a control panel mounted to the front panel. The control panel may include a body. The body may include an attachment portion. The attachment portion may include a first perimeter and a plurality of latches. The plurality of latches disposed along the first perimeter. The washing machine appliance may include a fascia. The fascia may include a second perimeter and a plurality of snaps. The second perimeter may correspond to the first perimeter. The plurality of snaps may be disposed along the second perimeter to engage with the plurality of latches.

19 Claims, 9 Drawing Sheets

LOCATING FEATURES FOR A CONTROL PANEL OF A DOMESTIC APPLIANCE

FIELD OF THE DISCLOSURE

The present subject matter relates generally to a domestic appliance and more particularly to a control panel of a domestic appliance.

BACKGROUND OF THE DISCLOSURE

Certain domestic appliances may include a variety of controls configured to receive inputs for performing certain operations within the appliance. According to one example, a laundry treatment appliance such as a washing machine appliance may include a touch interface including a variety of touch inputs. For instance, capacitive touch sensing types of controls that rely on sensitivity to a user's touch may be included on a control panel of the appliance. These controls may be provided as part of a user interface assembly for controlling various operations of the appliance.

In some instances, the control panel can be removably attached to the domestic appliance such that an operator is capable of accessing the variety of components housed within the control panel (e.g., during servicing of the domestic appliance). A robust attachment of the control panel to the domestic appliance is necessary to maintain structural integrity of the control panel and convey quality craftsmanship to a user of the domestic appliance. However, existing control panels have numerous drawbacks. Particularly, accessing components that are housed within the typical control panel is often difficult or cumbersome for an operator. For example, in many cases, an additional domestic appliance can be stacked on top of the domestic appliance including the control panel that an operator may be attempting to access. In such instances, the additional domestic appliance is required to be unstacked prior to accessing the electrical components housed within the control panel. The unstacking of the additional domestic appliance can be a labor-intensive task that often requires multiple individuals to complete. As another example, many domestic appliances require beauty plugs to cover fasteners that connect the control panel to the domestic appliance. These beauty plugs often are visually undesirable to a user of the domestic appliance. Moreover, these beauty plugs can detach over time, thus exposing unsightly fasteners to a user of the domestic appliance.

Accordingly, a control panel for a domestic appliance that obviates one or more of the above-mentioned drawbacks would be useful.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet. The cabinet may include a front panel and a bracket cross brace. The bracket cross brace may be mounted to the front panel to brace the front panel. The washing machine appliance may include a control panel. The control panel may include a body. The body may be attached to the front panel via the bracket cross brace. The body may include an attachment portion. The attachment portion may include a first perimeter and a plurality of latches disposed along the first perimeter. Each latch of the plurality of latches may include an assembly tab and a disassembly rib. The washing machine appliance may include a fascia mounted to the attachment portion. The fascia may include a second perimeter corresponding to the first perimeter, the fascia may include a plurality of resilient snaps being disposed along the second perimeter. Each resilient snap of the plurality of resilient snaps may be aligned to a latch of the plurality of latches. Each resilient snap of the plurality of resilient snaps may be in selective snapped engagement with the assembly tab of the corresponding latch of the plurality of latches. Each resilient snap of the plurality of resilient snaps may be selectively engageable with the disassembly rib of the corresponding latch of the plurality of latches to disengage each resilient snap of the plurality of resilient snaps from the corresponding latch of the plurality of latches during disassembly.

In another exemplary aspect of the present disclosure, a washing machine appliance is provided. The washing machine appliance may include a cabinet. The cabinet may include a front panel at a top thereof. The washing machine may include a control panel mounted to the front panel. The control panel may include a body. The body may include an attachment portion. The attachment portion may include a first perimeter and a plurality of latches. The plurality of latches disposed along the first perimeter. The washing machine appliance may include a fascia. The fascia may include a second perimeter and a plurality of resilient snaps. The second perimeter may correspond to the first perimeter. The plurality of resilient snaps may be disposed along the second perimeter to engage with the plurality of latches.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
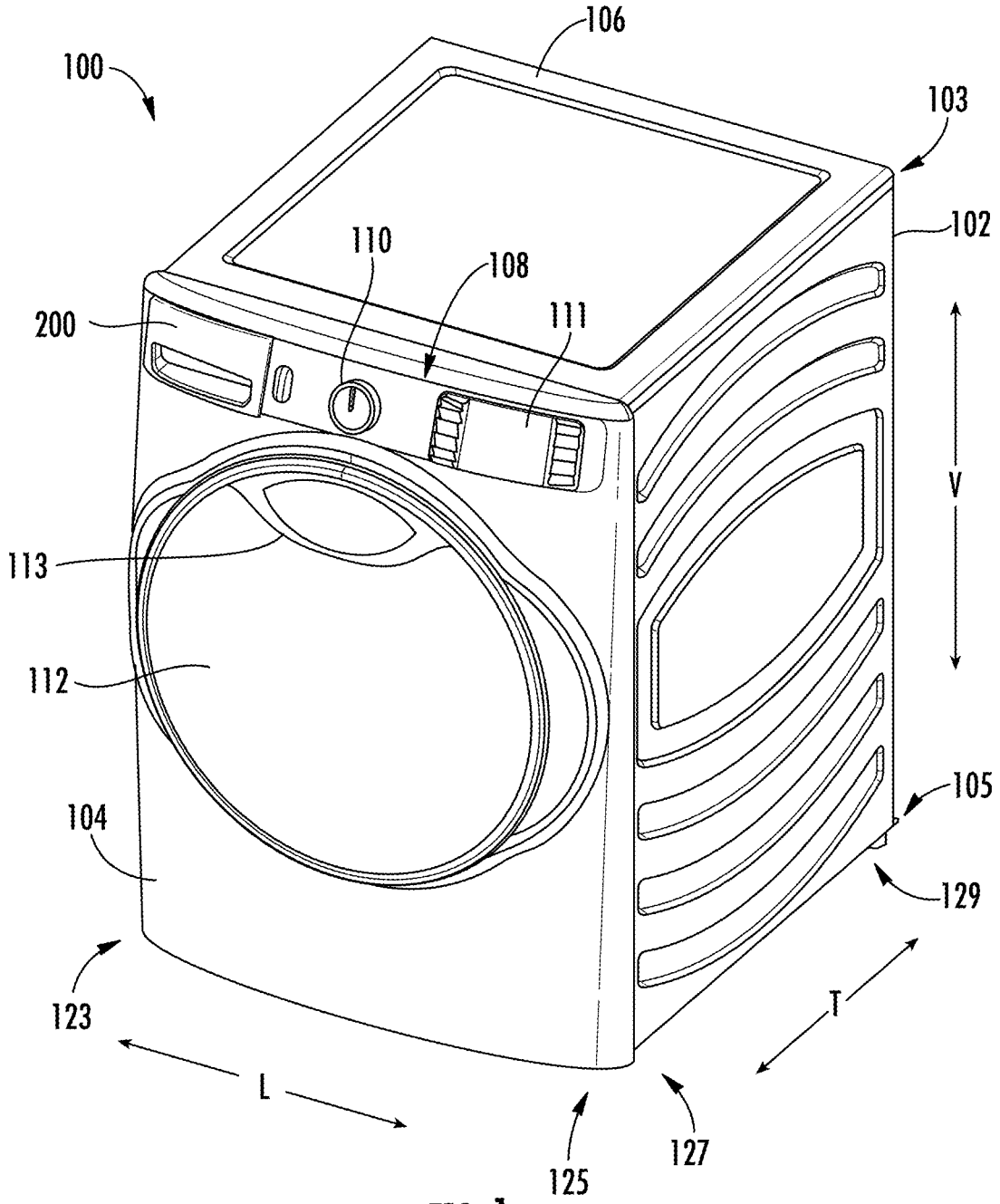
FIG. 1 provides a perspective view of a washing machine appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

As will be appreciated, embodiments of the present subject matter generally relate to a domestic appliance (e.g., laundry appliance such as a washing machine appliance or a dryer appliance). The domestic appliance can include a cabinet, a control panel, and a fascia that is removably attached to the control panel. The cabinet can include a front panel positioned at a front of the domestic appliance. The front panel may include fastener holes for accepting the control panel. The control panel can include a plurality of vertical tabs that are located to and aligned with a plurality of corresponding slots on the front panel. Moreover, the control panel can include a plurality of locators that receive a plurality of resilient snaps located on the fascia.

Notably, the exemplary fascia has a robust attachment to the control panel of the domestic appliance. The fascia may advantageously be assembled or disassembled from a front of the control panel (e.g., when compared to traditional fascia of domestic appliances that are assembled or disassembled from a rear of the control panel). Additionally or alternatively, the exemplary fascia is attached to the control panel without the use of additional parts (e.g., beauty plugs, trim pieces, etc.) that may typically be used to cover fasteners. As will be understood in more detail below, these features advantageously allow the control panel to be serviced without needing to pull the entire domestic appliance away from an installation position (e.g., the position in which the domestic appliance is installed, such as within a user's household).

Figure 2:
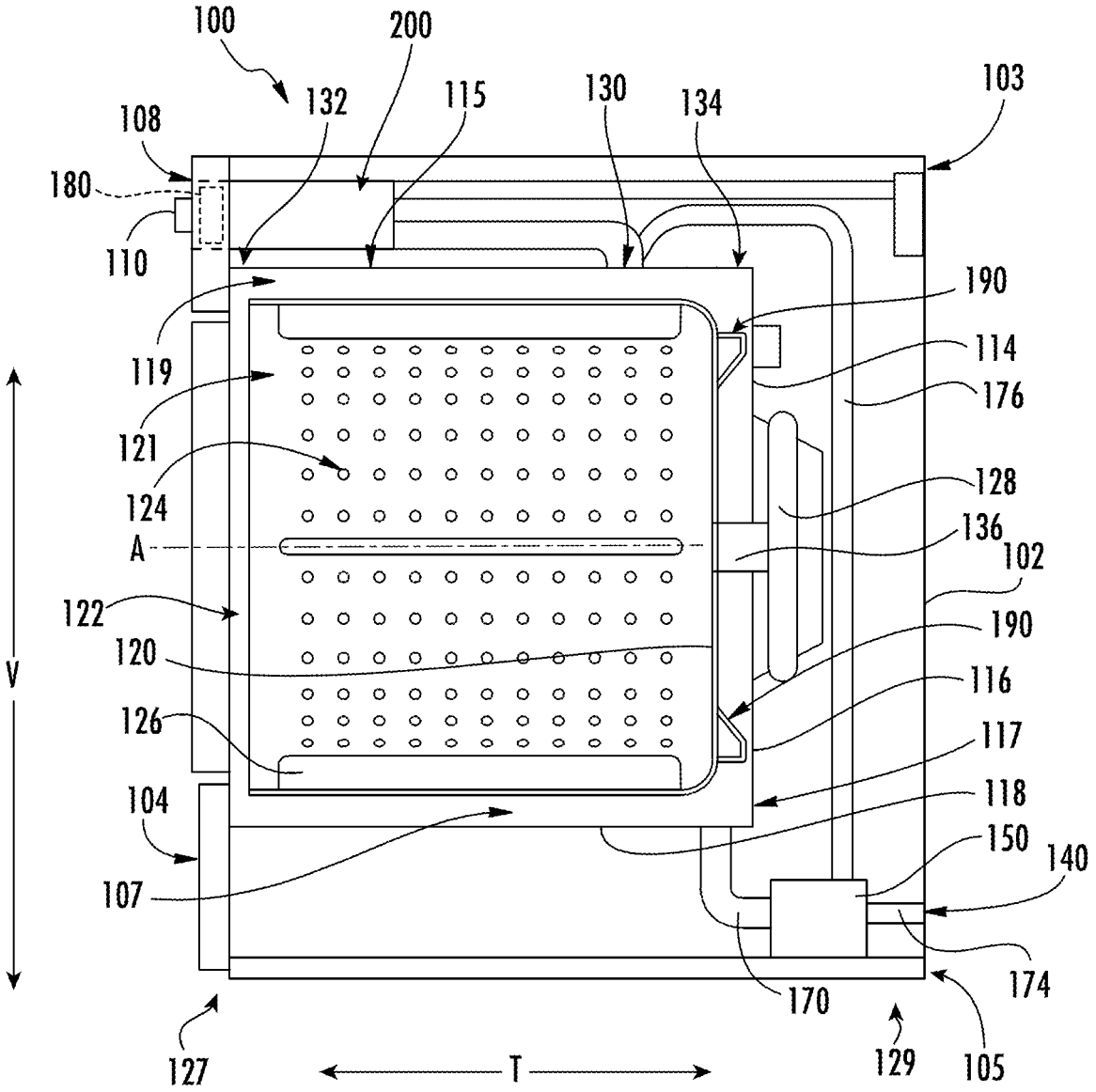
FIG. 2 provides a side, cross-sectional view of the exemplary washing machine appliance of FIG. 1.

Referring now to the figures, a washing machine appliance 100 will be described according to one or more exemplary embodiments of the present subject matter. FIGS. 1 and 2 provide various views of the washing machine appliance 100 according to one or more exemplary aspects of the present subject matter. In particular, FIG. 1 provides a front, perspective view of the washing machine appliance 100 and FIG. 2 provides a side, section view of washing machine appliance 100. As shown in FIG. 1, washing machine appliance 100 defines a vertical direction V, a lateral direction L, and a transverse direction T. The vertical direction V, the lateral direction L, and transverse direction T may be mutually perpendicular as to define an orthogonal direction system.

The washing machine appliance 100 may generally include a cabinet 102. In some embodiments, the cabinet 102 extends between a top 103 and a bottom 105, approximately along the vertical direction V. In addition, in some embodiments, cabinet 102 extends between a first side 123 and a second side 125 approximately along the lateral direction L. Further, in some embodiments, the cabinet 102 extends between a front 127 and a rear 129 approximately along the transverse direction T.

In some embodiments, cabinet 102 includes a front panel 104. The cabinet may include a door 112 that may be mounted to front panel 104 disposed at the front 127 of the cabinet 102. For instance, the door 112 may be rotatably mounted to the front panel 104 such that the door 112 may be transitionable between an open position (not shown) wherein access to a wash drum or basket 120 (see e.g., FIG. 2) located within cabinet 102 is facilitated, and a closed position (see e.g., FIGS. 1 and 2) wherein access to basket 120 is hindered. A user may pull on a handle 113 in order to selectively adjust door 112 between the open and closed positions. Further, cabinet 102 may also include a top panel 106 positioned at top 103 of cabinet 102.

In some embodiments, the washing machine appliance 100 includes a control panel 108 that is mounted to the front panel 104. The control panel 108 may include a plurality of input selectors 110. Control panel 108 and input selectors 110 may collectively form a user interface input for operator selection of machine cycles and features. In some embodiments, e.g., as shown in FIG. 1, the control panel 108 includes a display 111 configured to present or indicate selected features, a countdown timer, or other items of interest to machine users.

Operation of washing machine appliance 100 is controlled by a processing device or controller 180 that is operatively coupled to or housed within the control panel 108 for user manipulation (e.g., to select washing cycles and features). For instance, in response to user manipulation of control panel 108, controller 180 operates the various components of washing machine appliance 100 to execute selected machine cycles and features, which will be described in further detail herein.

Controller 180 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog or digital logic circuitry (such as switches, amplifiers, integrators, comparators, flip-flops, gates, and the like) to perform control functionality instead of relying upon software. Control panel 108 and other components of washing machine appliance 100 may be in communication with controller 180 via one or more signal lines or shared communication busses.

As shown in FIG. 2, a tub 114 defines a wash fluid compartment 119 configured for receipt of a wash fluid. Thus, tub 114 is configured for containing wash fluids, e.g., during operation of washing machine appliance 100. In some embodiments, the tub 114 includes a back wall 116 and a sidewall 118. Additionally, in some embodiments, the tub 114 extends between a top 115 and a bottom 117 approximately along the vertical direction V. Further, in some embodiments, the tub 114 extends between a front 132 and a rear 134 approximately along the transverse direction T.

In some embodiments, the basket 120 is rotatably mounted within tub 114 in a spaced apart relationship from tub sidewall 118 and tub back wall 116. One or more bearing assemblies may be placed between basket 120 and tub 114 to allow for rotational movement of basket 120 relative to tub 114. In some embodiments, the basket 120 defines a wash chamber 121 and an opening 122. Opening 122 of basket 120 may permit access to wash chamber 121 of basket 120, e.g., in order to load articles into basket 120 and remove articles from basket 120. Basket 120 also defines a plurality of perforations 124 that are provided to facilitate fluid communication between an interior of basket 120 and tub 114. In some embodiments, a sump 107 is defined by tub 114 and is configured for receipt of wash fluid during operation of washing machine appliance 100. For example, during operation of washing machine appliance 100, wash fluid may be urged by gravity from basket 120 to sump 107 through the plurality of perforations 124.

A spout 130 is configured for directing a flow of wash fluid into tub 114. Spout 130 may be in fluid communication with a water jet system (e.g., water jet system 250 or 450 described in more detail below) in order to direct a wash fluid into tub 114. A pump assembly 150 (shown schematically in FIG. 2) is located beneath tub 114 for draining wash fluid from the tub 114. Pump assembly 150 is in fluid communication with sump 107 of tub 114 via a conduit 170. Thus, conduit 170 directs fluid from tub 114 to pump assembly 150. Pump assembly 150 is also in fluid communication with a drain 140 via piping 174. Pump assembly 150 can urge fluid disposed in sump 107 to drain 140 during operation of washing machine appliance 100 in order to remove fluid from tub 114. Fluid received by drain 140 from pump assembly 150 is directed out of washing machine appliance 100, e.g., to a sewer or septic system.

In addition, pump assembly 150 is configured for recirculating washing fluid within tub 114. Thus, pump assembly 150 is configured for urging fluid from sump 107, e.g., to spout 130. For example, pump assembly 150 may urge washing fluid in sump 107 to spout 130 via hose 176 during operation of washing machine appliance 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 is in mechanical communication with basket 120 in order to selectively rotate basket 120, e.g., during an agitation or a rinse cycle of washing machine appliance 100 as described below. In particular, a shaft 136 mechanically couples motor 128 with basket 120 and drivingly rotates basket 120 about a shaft or central axis A, e.g., during a spin cycle. Ribs 126 may extend from basket 120 into wash chamber 121. Ribs 126 may assist agitation of articles disposed within wash chamber 121 during operation of washing machine appliance 100. For example, ribs 126 may lift articles disposed in basket 120 during rotation of basket 120.

Also shown in FIG. 2 is a balancing apparatus 190. Balancing apparatus 190 can include a balancing ring, for example. The balancing ring can have an annular cavity in which a balancing material is free to rotate and move about. For example, the balancing material can be a fluid such as water or can be balancing balls. The balancing ring can include one or more interior baffles. Although a single balancing ring or apparatus 190 is shown in FIG. 2, any number of such rings or apparatuses can be included in washing machine appliance 100 and can be placed according to any known or desirable configuration. For example, two balancing rings can be respectively placed at the front and back of basket 120.

As further shown schematically in FIG. 2, washing machine appliance 100 includes a dispenser assembly 200 for the dispensing of additives, e.g., detergent, bleach, fabric softener, liquid rinse sanitizer, etc. For instance, the dispenser assembly 200 may generally include one or more additive chambers for receiving various additives. Additionally, each additive chamber may include features for dispensing or directing the additives to wash fluid compartment 119 of tub 114 during operation of washing machine appliance 100.

Figure 3:
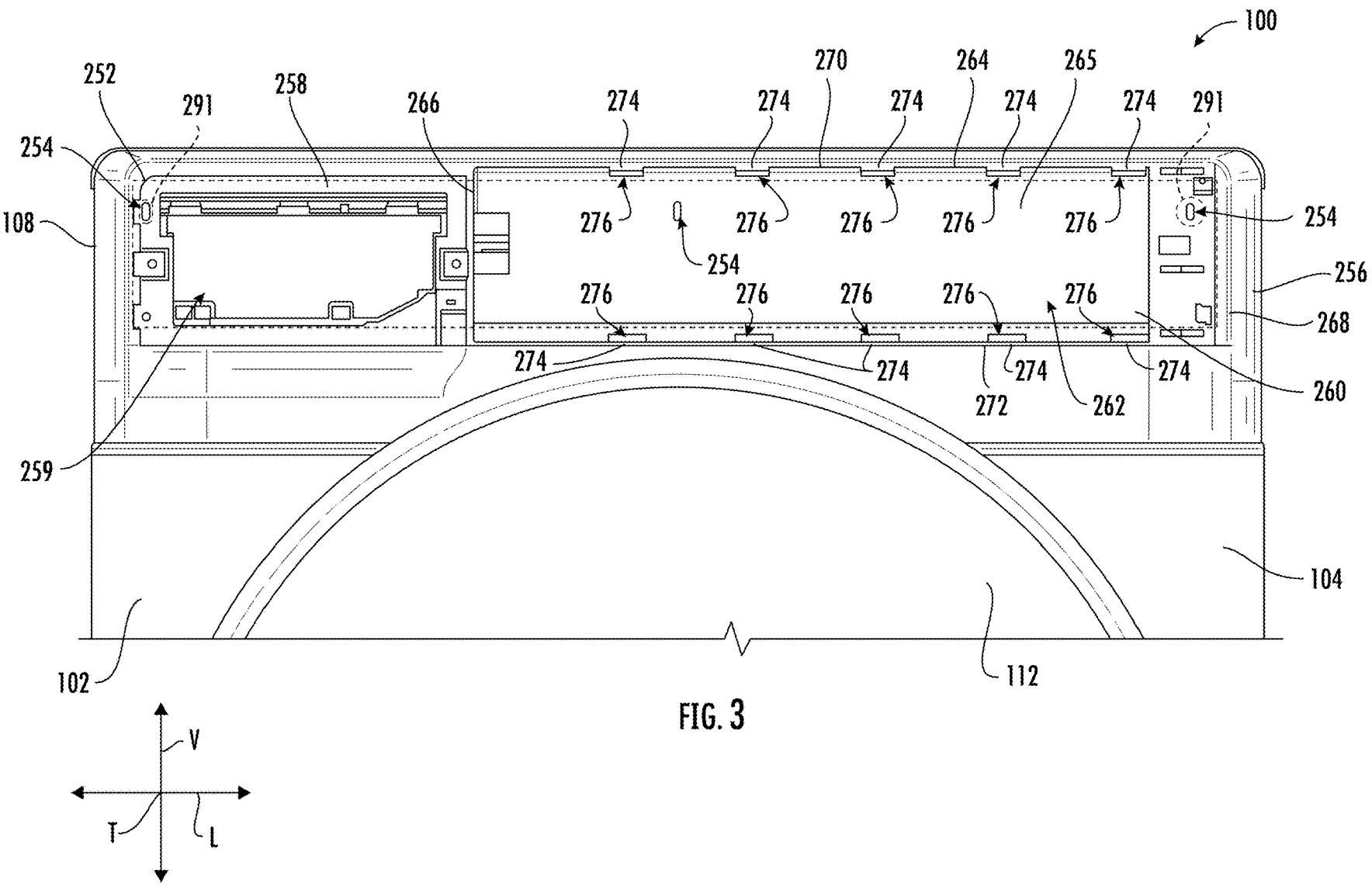
FIG. 3 provides a front view of the washing machine appliance of FIG. 1 with a fascia removed to reveal an attachment portion of the control panel.

Referring now to FIG. 3, a front view of a portion of the washing machine appliance 100 is provided. As mentioned above, in some embodiments, the cabinet 102 of the washing machine appliance 100 comprises a front panel 104 and a control panel 108 mounted to the front panel 104. In some embodiments, the front panel 104 includes a bracket cross brace 252 for bracing (e.g., providing structural integrity for) the front panel 104. The bracket cross brace 252 may be mounted (e.g., fastened via mechanical fasteners) to the front panel 104 at a top portion of the front panel 104. In some embodiments, the body 256 of the control panel 108 includes a plurality of vertical tabs 278 that engage with a plurality of corresponding locator slots 291 defined through the front panel 104. During assembly of the control panel, the plurality of vertical tabs 278 are inserted into the plurality of corresponding locator slots 291 to locate or align the control panel 108 to the front panel 104 of the washing machine appliance 100.

Additionally or alternatively, the bracket cross brace 252 may provide a mounting location for the control panel 108. The bracket cross brace 252 may define a first set of fastener holes therethrough. The first set of fastener holes may align with a second set of fastener holes 254 defined through the control panel 108. A plurality of mechanical fasteners (e.g., screws, bolts, etc.) may be disposed through the first set of fastener holes and the second set of fastener holes 254 to secure a body 256 of the control panel 108 to the front panel 104.

In some embodiments, the body 256 of the control panel 108 includes a dispenser portion 258 and an attachment portion 260. The dispenser portion 258 and the attachment portion 260 may be positioned adjacent to one another (e.g., along the lateral direction L). For instance, the dispenser portion 258 may be positioned at or extended from a first side 255 (e.g., the left side) of the control panel 108. The dispenser portion 258 may define an opening 259 for receiving the dispenser assembly 200. The attachment portion 260 may be positioned at or extended from a second side 257 (e.g., the right side) of the control panel 108. The attachment portion 260 may define a component housing 262 of the control panel 108. In particular, the component housing 262 may hold or house the components (e.g., electrical components) for the user interface of the control panel 108. The attachment portion 260 may receive a fascia 300 (e.g., FIGS. 4 through 9) to cover or enclose the component housing 262 of the control panel 108.

Notably, the fascia 300 allows the components within the control panel 108 to be serviced without having to pull the domestic appliance 100 out of its installation position. Additionally or alternatively, the fascia 300 may advantageously be connected and secured to the control panel 108 without fasteners being visible to a user of the domestic appliance 100 or without the use of additional parts (e.g., beauty plugs, trim pieces, etc.) that are commonly used to cover the fasteners that connect the fascia to the control panel.

The attachment portion 260 may include a first perimeter 264 and a base panel 265. The first perimeter 264 may surround the base panel 265. Moreover, the base panel 265 may be offset from the first perimeter 264 (e.g., along the transverse direction T) to define the component housing 262. For instance, the base panel 265 may be positioned inward (e.g., along the transverse direction T) of the first perimeter 264 such that the component housing 262 is defined. In some embodiments, the first perimeter 264 may define a rectangular shape that forms an outer boundary of the component housing 262. Particularly, the first perimeter 264 may include a first edge 266, a second edge 268, a top edge 270, and a bottom edge 272. The first edge 266 and the second edge 268 may be spaced apart along the lateral direction L. The top edge 270 and the bottom edge 272 may be spaced apart along the vertical direction V. The attachment portion 260 may include a plurality of latches 274 disposed along the first perimeter 264. Particularly, the plurality of latches 274 may be disposed along the top edge 270 or the bottom edge 272 of the first perimeter 264. In some embodiments, each latch of the plurality of latches 274 defines a slot 276 through the base panel 265. As will be appreciated, each slot 276 may receive a portion of the fascia 300 (e.g., to locate and align the fascia 300 to the control panel 108).

Figure 4:
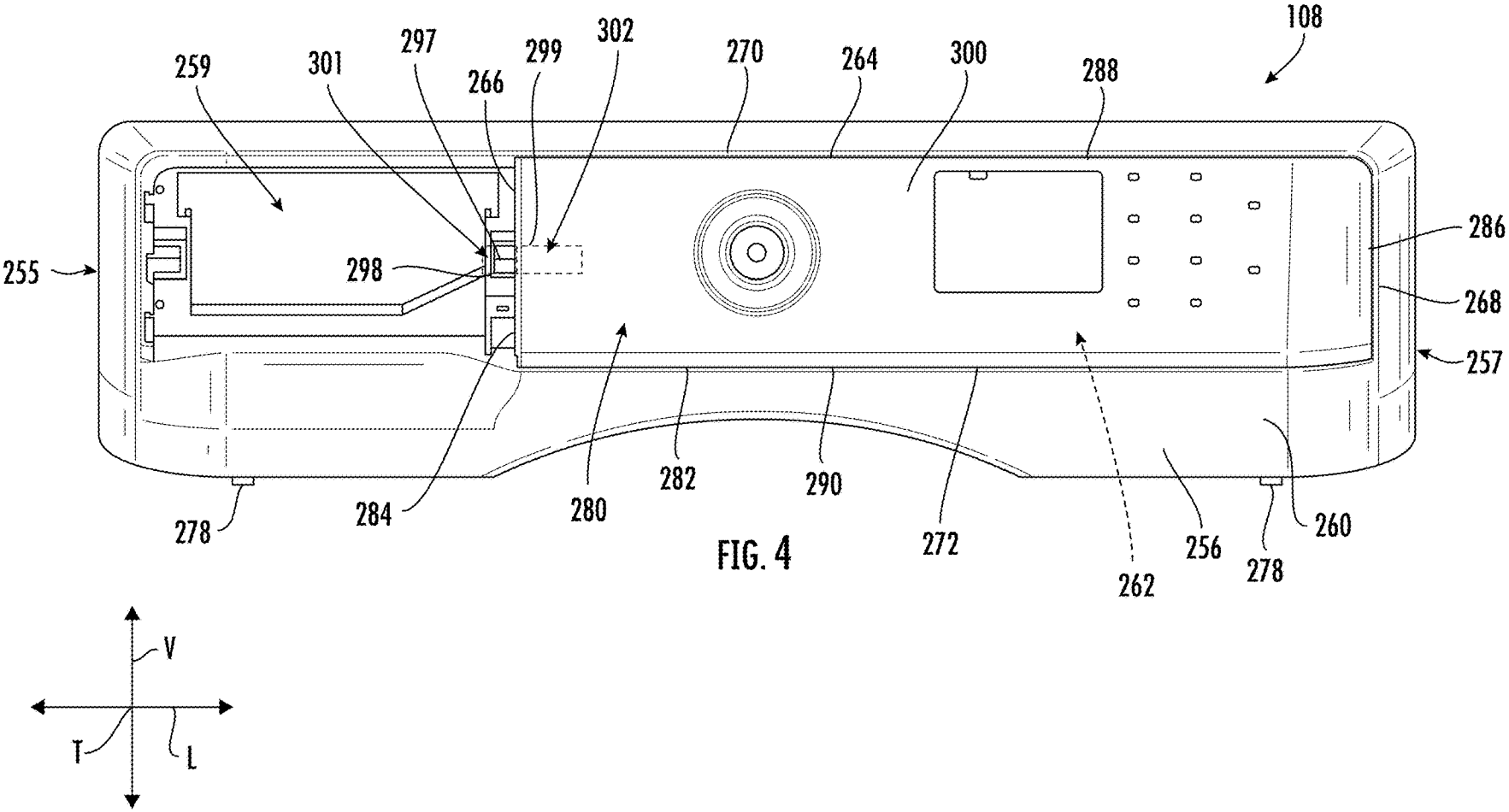
FIG. 4 provides a front view of a control panel of the washing machine appliance of FIG. 1 with a fascia in an engaged position.
Figure 5:
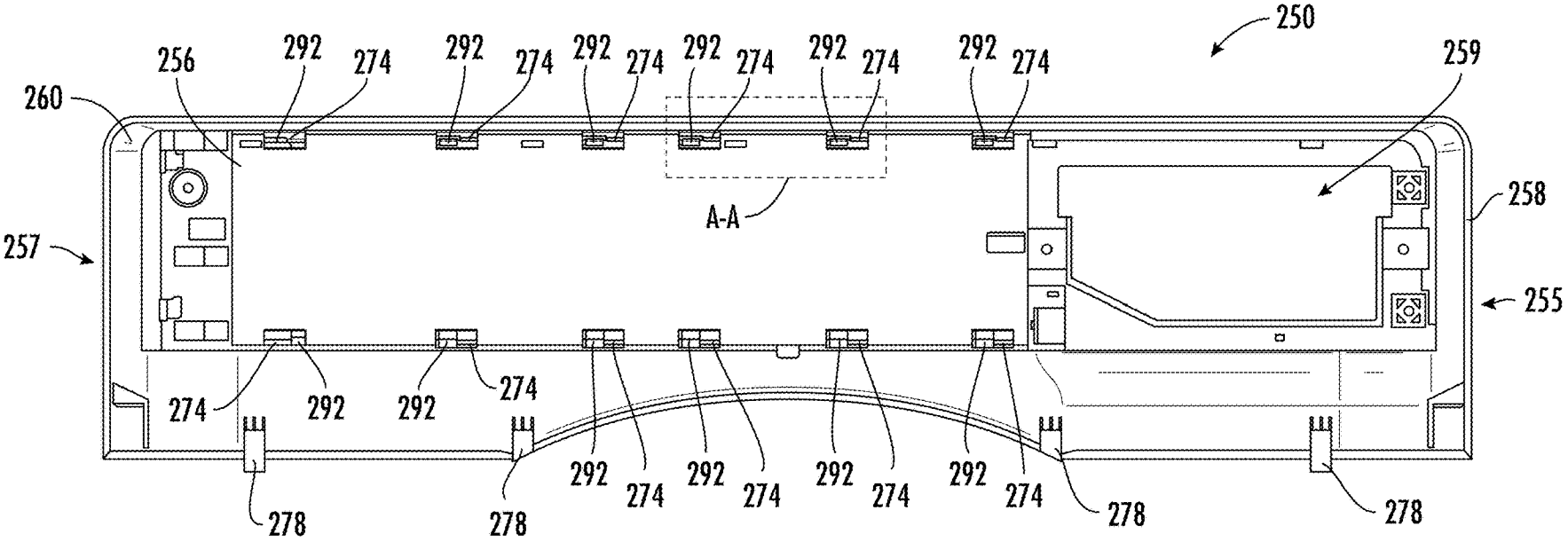
FIG. 5 provides a rear view of a control panel of the washing machine appliance of FIG. 1 with a fascia in an engaged position FIG. 6 provides a close-up view of FIG. 5 taken from section A-A.
Figure 6:
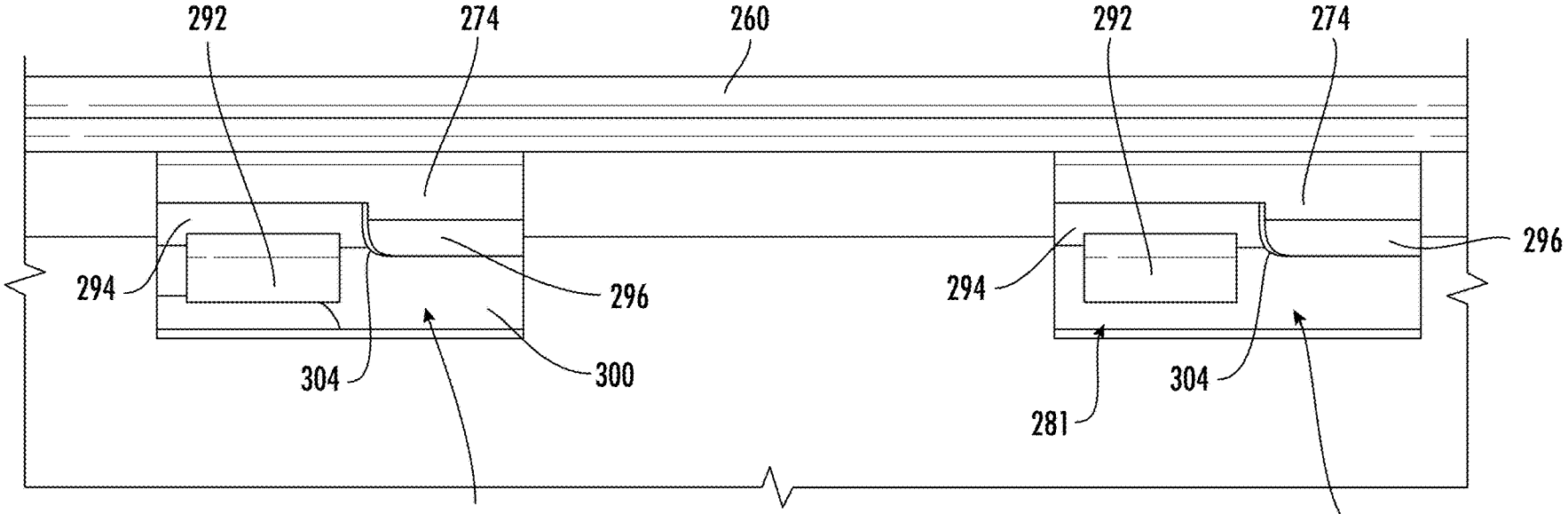
Figure 7:
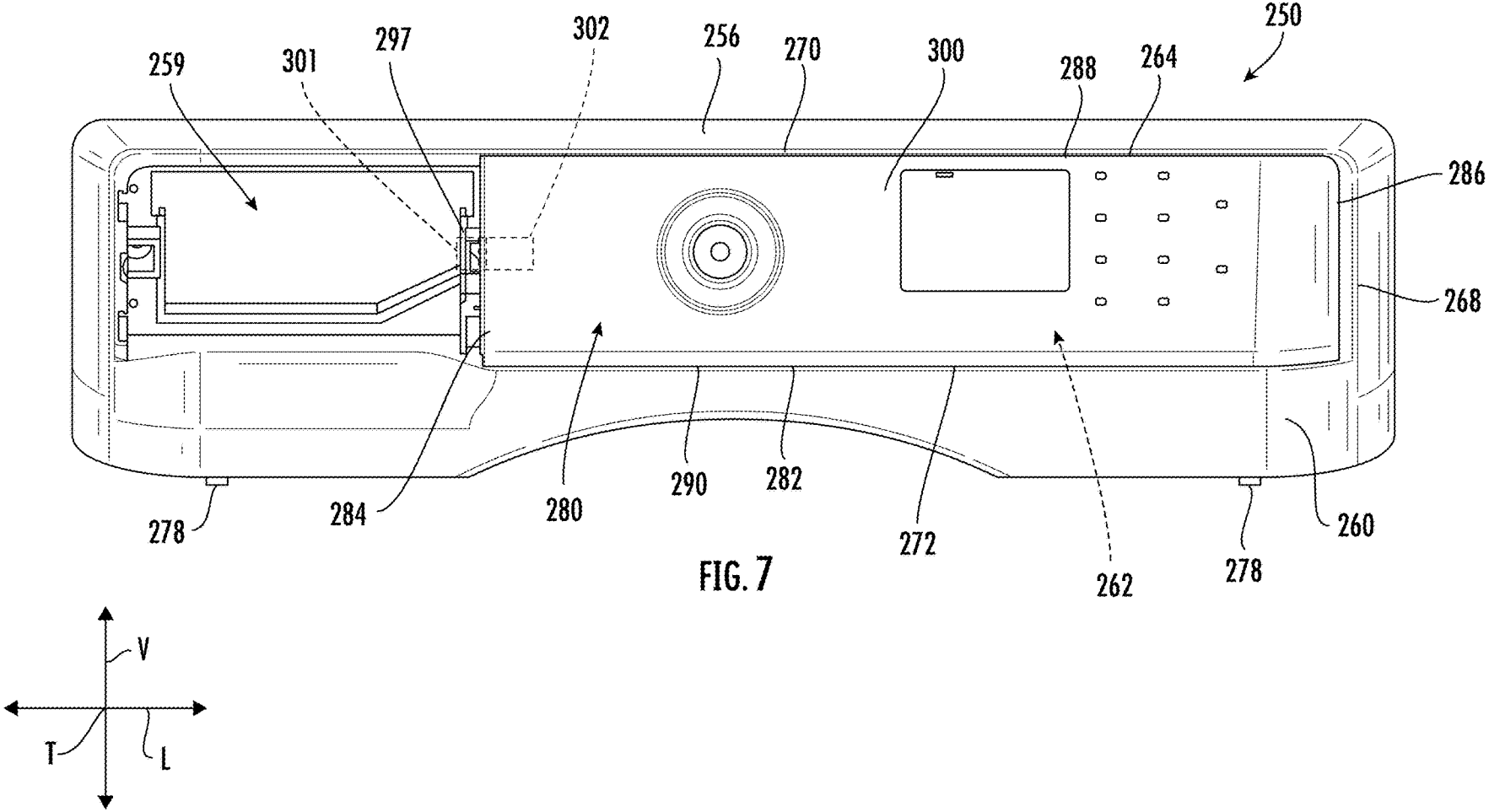
FIG. 7 provides a front view of a control panel of the washing machine appliance of FIG. 1 with a fascia in a disengaged position.
Figure 8:
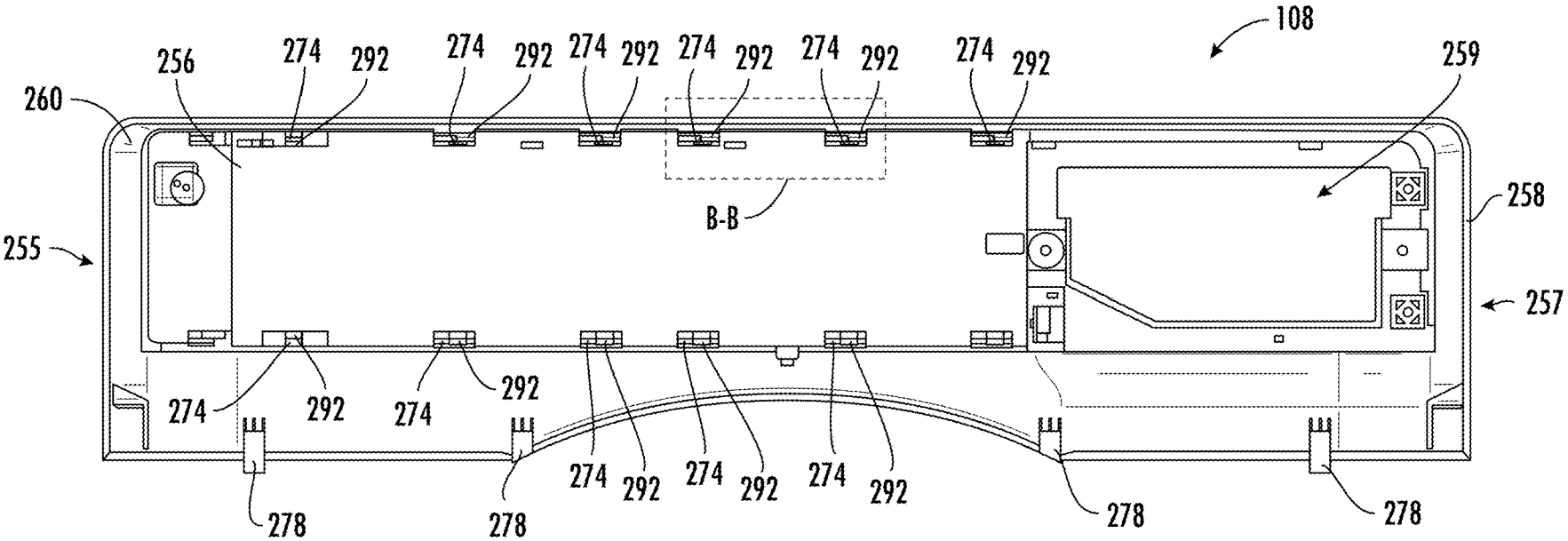
FIG. 8 provides a rear view of the control panel of the washing machine appliance of FIG. 1 with a fascia in a disengaged position.
Figure 9:
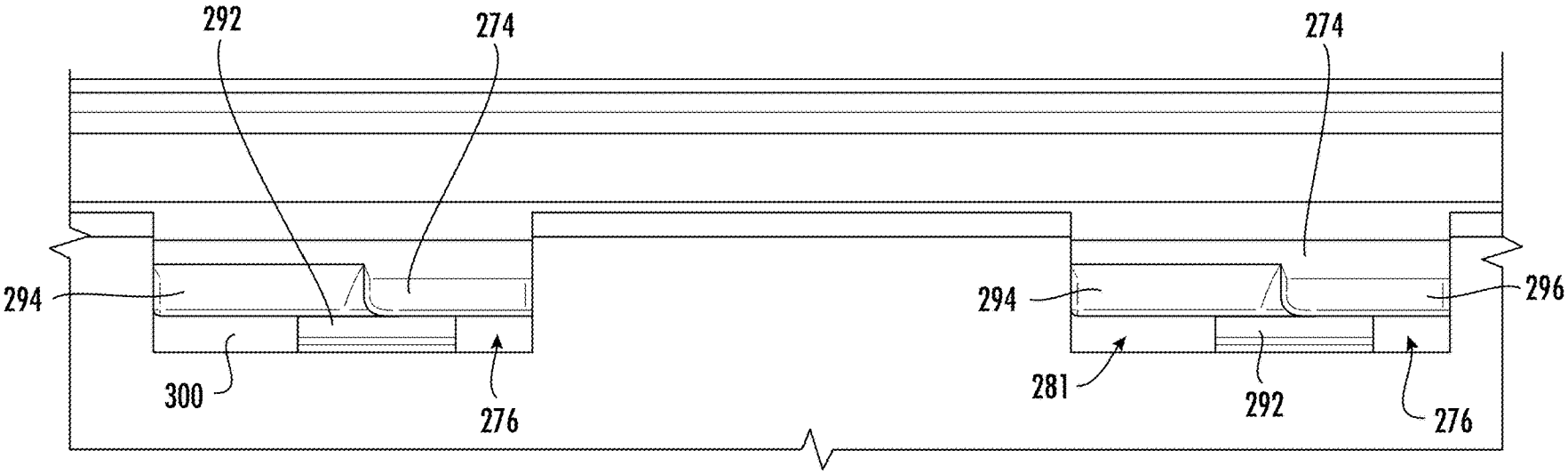
FIG. 9 provides a close-up view of FIG. 8 taken from section B-B.

Referring now to FIGS. 4 through 6, views of the control panel 108 and the fascia 300 mounted thereto are provided. As illustrated in FIGS. 4 through 6, the fascia 300 may be in an engaged position (e.g., a position wherein the fascia 300 is engaged and secured to the attachment portion 260 of the control panel 108 to fully cover the component housing 262). The fascia 300 may include a front side 280 and a rear side 281 (e.g., FIG. 6) spaced apart along the transverse direction T. The fascia 300 may also include a second perimeter 282. The shape of the second perimeter 282 may generally correspond to the shape of the first perimeter 264 of the attachment portion 260. For instance, the second perimeter 282 may define the same or a similar rectangular shape of the first perimeter 264. The second perimeter 282 may include a first edge 284, a second edge 286, a top edge 288, and a bottom edge 290. The first edge 284 and the second edge 286 of the second perimeter 282 may be spaced apart along the lateral direction L. The top edge 288 and the bottom edge 290 of the second perimeter 282 may be spaced apart along the vertical direction V.

The fascia 300 may also include a plurality of resilient snaps 292. For example, referring particularly to FIGS. 5 and 6, the plurality of resilient snaps 292 may be disposed along the second perimeter 282 at the rear side 281 of the fascia 300. Particularly, the plurality of resilient snaps 292 may be disposed along the top edge 288 or the bottom edge 290 of the second perimeter 282. Each resilient snap of the plurality of resilient snaps 292 may be aligned with a discrete latch of the plurality of latches 274. The location of the plurality of latches 274 and the plurality of resilient snaps 292 (e.g., at their respective perimeters) advantageously increases or maximizes the space of the component housing 262 (e.g., when compared to the space of traditional component housing 262*s* that utilize connectors positioned throughout the component housing 262). Moreover, as will be appreciated in more detail below, each latch of the plurality of latches 274 may include features for improving assembly and disassembly of the fascia 300 to the control panel 108.

For instance, as is best illustrated in FIG. 6, each latch of the plurality of latches 274 may include an assembly tab 294 and disassembly rib 296. In some embodiments, the assembly tab 294 of each latch is extended from the first perimeter 264 (e.g., along the vertical direction V) toward the center of the control panel 108. During assembly of the control panel 108, each resilient snap of the plurality of resilient snaps 292 may be "snapped" onto the assembly tab 294 of the corresponding latch of the plurality of latches 274. For example, during assembly of the control panel 108, an operator may locate the fascia 300 to the attachment portion 260 of the control panel 108 by aligning the plurality of resilient snaps 292 with the corresponding plurality of latches 274. The operator may push the fascia 300 toward the attachment portion 260 such that each resilient snap of the plurality of resilient snaps 292 engages with a corresponding assembly tab 294 of the plurality of latches 274. Particularly, when the fascia 300 is pushed or motivated toward the attachment portion 260, each resilient snap of the plurality of resilient snaps 292 may be temporarily displaced by the corresponding assembly tab 294 until the resilient snap of the plurality of resilient snaps 292 passes over and engages with the corresponding assembly tab 294.

In some embodiments, after the fascia 300 is connected to the attachment portion 260, the fascia 300 may be secured to the attachment portion 260 via a lock 297. For instance, as is illustrated in FIG. 4, the first edge 266 of the attachment portion 260 may include the first lock element 298 of the lock 297. The first lock element 298 may define a first fastener hole 301 through the first edge 266 of the attachment portion 260. In addition, the first edge 266 of the fascia 300 may include a second lock element 299 that defines a second fastener hole 302 therethrough. When the plurality of resilient snaps 292 are engaged with the plurality of latches 274 the first fastener hole 301 and the second fastener hole 302 may be aligned such that a mechanical fastener (e.g., a screw, bolt, etc.) may be disposed through the first fastener hole 301 and the second fastener hole 302 to secure or "lock" the fascia 300 to the attachment portion 260.

In some embodiments, the disassembly ribs 296 of each latch of the plurality of latches 274 may be extended from the first perimeter 264 (e.g., along the vertical direction V) toward the center of the control panel 108. In some embodiments, the disassembly rib 296 may be positioned between the base panel 265 and the corresponding assembly tab 294. The disassembly ribs 296 may include a disengagement edge 304 (e.g., FIG. 6) that the corresponding resilient snap of the plurality of resilient snaps 292 may engage with to displace the resilient snap. Particularly, the disengagement edge 304 may define a chamfered, sloped, or curved shape that may motivate the corresponding resilient snap of the plurality of resilient snaps 292 toward a disengaged position.

To disassemble or remove the fascia 300 from the control panel 108 (e.g., for servicing of components housed within the component housing 262). The fascia may be unlocked or unsecured from the control panel 108 (e.g., by removing the mechanical fasteners from the lock 297) and slid (e.g., to the left) from the engaged position to a disengaged position (wherein the fascia 300 is not connected to the control panel 108). As an illustrative example, referring now to FIGS. 7 through 9, views of the fascia 300 in the disengaged position are provided. During disassembly of the fascia 300 the plurality of latches 274 may disengage or disconnect the plurality of resilient snaps 292 from the control panel 108. Particularly, as the fascia 300 is slid from the engaged position to the disengaged position, the plurality of resilient snaps 292 may engage with the disassembly ribs 296 of the corresponding latch of the plurality of latches 274. As the plurality of resilient snaps 292 contact the disengagement edge 304 of the corresponding disassembly rib 296, the plurality of resilient snaps 292 may be freed from their engagement with the corresponding assembly tab 294. In this regard, an operator may be capable of removing the fascia 300 to access the component housing 262 without having to access the rear of the control panel 108.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet comprising a front panel and a bracket cross brace, the bracket cross brace being mounted to the front panel to brace the front panel;

a control panel comprising a body, the body being attached to the front panel via the bracket cross brace, the body comprising an attachment portion, the attachment portion comprising a first perimeter and a plurality of latches disposed along the first perimeter, each latch of the plurality of latches comprising an assembly tab and a disassembly rib; and a fascia mounted to the attachment portion, the fascia comprising:

a second perimeter corresponding to the first perimeter; and a plurality of snaps being disposed along the second perimeter, each snap of the plurality of snaps being aligned to a latch of the plurality of latches, wherein each snap of the plurality of snaps is in selective snapped engagement with the assembly tab of the corresponding latch of the plurality of latches, and wherein each snap of the plurality of snaps is selectively engageable with the disassembly rib of the corresponding latch of the plurality of latches to disengage each snap of the plurality of snaps from the corresponding latch of the plurality of latches during disassembly.

2. The washing machine appliance of claim 1, wherein the attachment portion comprises a base panel, wherein the first perimeter surrounds the base panel, and wherein the base panel is offset from the first perimeter to define a component housing.

3. The washing machine appliance of claim 2, wherein each latch of the plurality of latches defines a slot through the base panel for receiving the corresponding snap of the plurality of snaps.

4. The washing machine appliance of claim 2, wherein each assembly tab is extended from the perimeter of the attachment portion, wherein each disassembly rib is extended from the perimeter of the attachment portion, and wherein the disassembly rib is positioned between the tab and the base panel.

5. The washing machine appliance of claim 1, wherein the first perimeter comprises a top edge and a bottom edge, wherein the plurality of latches are disposed along the top edge of the first perimeter or the bottom edge of the first perimeter, wherein the second perimeter comprises a top edge and a bottom edge, wherein the plurality of snaps are disposed along the top edge of the second perimeter or the bottom edge of the second perimeter.

6. The washing machine appliance of claim 1, wherein the front panel defines a plurality of locator slots, wherein the body comprises a plurality of vertical tabs, and wherein the plurality of vertical tabs are engaged with the plurality of locator slots.

7. The washing machine appliance of claim 1, wherein the bracket cross brace defines a first set of fastener holes therethrough, wherein the body defines a second set of fastener holes, wherein the first set of fastener holes corresponds to the second set of fastener holes, and wherein a plurality of mechanical fasteners are disposed through the first set of fasteners holes and the second set of fasteners holes to secure the body to the front panel.

8. The washing machine appliance of claim 1, wherein the attachment portion further comprises a first side and a second side, wherein the first side of the attachment portion comprises a first lock element, wherein the first lock element defines a first fastener hole through the first side of the attachment portion wherein the fascia comprises a first side and second side, wherein the fascia comprises a second lock element that defines a second fastener hole through the first side of the fascia, wherein the first fastener hole is aligned with the second fastener hole, and wherein the fascia is secured to the attachment portion via a mechanical fastener disposed through the first fastener hole and the second fastener hole.

9. The washing machine appliance of claim 1, wherein the body further comprises:

a dispenser portion positioned adjacent to the attachment portion, the dispenser portion defining an opening for receiving a dispenser assembly of the washing machine appliance.

10. A washing machine appliance comprising:

a cabinet comprising a front panel at a top thereof;

a control panel mounted to the front panel, the control panel comprising:

a body comprising an attachment portion, the attachment portion comprising a first perimeter and a plurality of latches, the plurality of latches disposed along the first perimeter, each latch of the plurality of latches comprising an assembly tab and a disassembly rib each extended from the first perimeter; and a fascia comprising a second perimeter and a plurality of snaps, the second perimeter corresponding to the first perimeter, the plurality of snaps disposed along the second perimeter to engage with the plurality of latches.

11. The washing machine appliance of claim 10, wherein each snap of the plurality of snaps is in selective snapped engagement with the assembly tab of the corresponding latch of the plurality of latches.

12. The washing machine appliance of claim 10, wherein each snap of the plurality of snaps is selectively engageable with the disassembly rib of the corresponding latch of the plurality of latches to disengage each snap of the plurality of snaps from the corresponding latch of the plurality of latches during disassembly.

13. The washing machine appliance of claim 10, wherein the attachment portion comprises a base panel, wherein the first perimeter surrounds the base panel, and wherein the base panel is offset from the first perimeter to define a component housing.

14. The washing machine appliance of claim 13, wherein each latch of the plurality of latches defines a slot through the base panel for receiving the corresponding snap of the plurality of snaps.

15. The washing machine appliance of claim 13, wherein each assembly tab is extended from the perimeter of the attachment portion, wherein each disassembly rib is extended from the perimeter of the attachment portion, and wherein the disassembly rib is positioned between the tab and the base panel.

16. The washing machine appliance of claim 13, wherein the attachment portion defines a plurality of fastener holes therethrough, and wherein the control panel is secured to the front panel via one or more fasteners disposed through the fastener holes and into the front panel.

17. The washing machine appliance of claim 10, wherein the first perimeter comprises a top edge and a bottom edge, wherein the plurality of latches are disposed along the top edge of the first perimeter or the bottom edge of the first perimeter, wherein the second perimeter comprises a top edge and a bottom edge, wherein the plurality of snaps are disposed along the top edge of the second perimeter or the bottom edge of the second perimeter.

18. The washing machine appliance of claim 10, wherein the attachment portion further comprises a first side and a second side, wherein the first side of the attachment portion comprises a first lock element, wherein the first lock element defines a first fastener hole through the first side of the attachment portion, and wherein the fascia comprises a first side and second side, wherein the fascia comprises a second lock element that defines a second fastener hole through the first side of the fascia, wherein the first fastener hole is aligned with the second fastener hole, and wherein the fascia is secured to the attachment portion via a mechanical fastener disposed through the first fastener hole and the second fastener hole.

19. The washing machine appliance of claim 10, wherein the body further comprises:

a dispenser portion positioned adjacent to the attachment portion, the dispenser portion defining an opening for receiving a dispenser assembly of the washing machine appliance.

* * * * *